United States Patent [19]

Simo

[11] Patent Number: 4,530,342

[45] Date of Patent: Jul. 23, 1985

[54] ARCHERY BOW

[76] Inventor: Miroslav A. Simo, 370 N. Delaplaine Rd., Riverside, Ill. 60546

[21] Appl. No.: 540,633

[22] Filed: Oct. 11, 1983

[51] Int. Cl.[3] ..... F41B 5/00

[52] U.S. Cl. ..... 124/24 R; 124/DIG. 1; 124/88

[58] Field of Search ..... 124/23 R, 24 R, 88, 124/86, 90, DIG. 1, 1

[56] References Cited

U.S. PATENT DOCUMENTS

| | | | |
|---|---|---|---|
| 1,885,962 | 11/1932 | Swenson et al. | 124/23 R |
| 4,020,819 | 5/1977 | Haines | 124/90 X |
| 4,244,345 | 1/1981 | Simo et al. | 124/DIG. 1 |
| 4,246,883 | 1/1981 | Ash | 124/24 R |
| 4,261,320 | 4/1981 | Barna | 124/24 R |
| 4,465,054 | 9/1984 | Nishioka | 124/24 R |

FOREIGN PATENT DOCUMENTS

| | | | |
|---|---|---|---|
| 2125760 | 12/1971 | Fed. Rep. of Germany | 124/23 R |

*Primary Examiner*—Richard J. Apley
*Assistant Examiner*—William R. Browne
*Attorney, Agent, or Firm*—Thomas W. Speckman

[57] ABSTRACT

An archery bow having a primary energy storage device with a propelling bowstring attached thereto and a secondary and weaker energy storage device including bow limbs having a draw bowstring attached at opposite ends. The draw bowstring and the propelling bowstring are in draw force communication between a predetermined position on the propelling bowstring and the draw bowstring whereby force is applied to the propelling bowstring only at that predetermined position. The tension in opposite ends of the propelling bowstring and the force in opposite ends of the primary energy storage means is equalized and when released propels the arrow in a reproducible fashion without wobble or porpoising.

22 Claims, 14 Drawing Figures

Fig. 1.
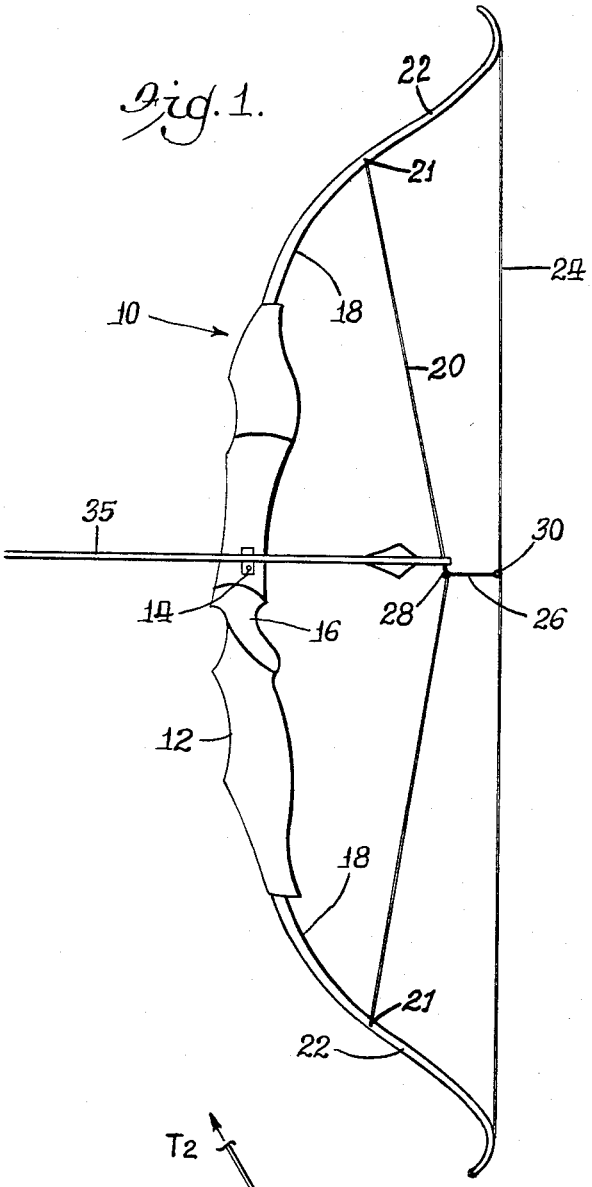
Fig. 3.
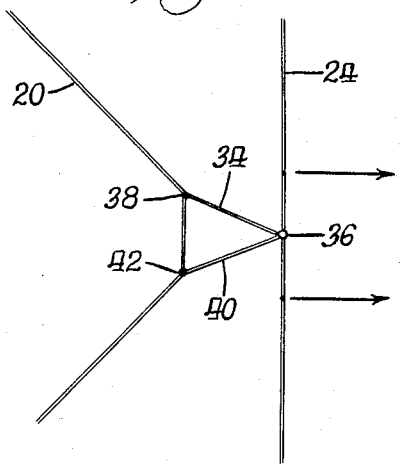
Fig. 4.
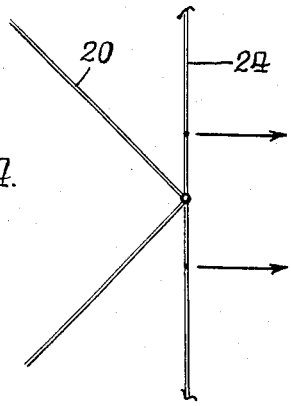
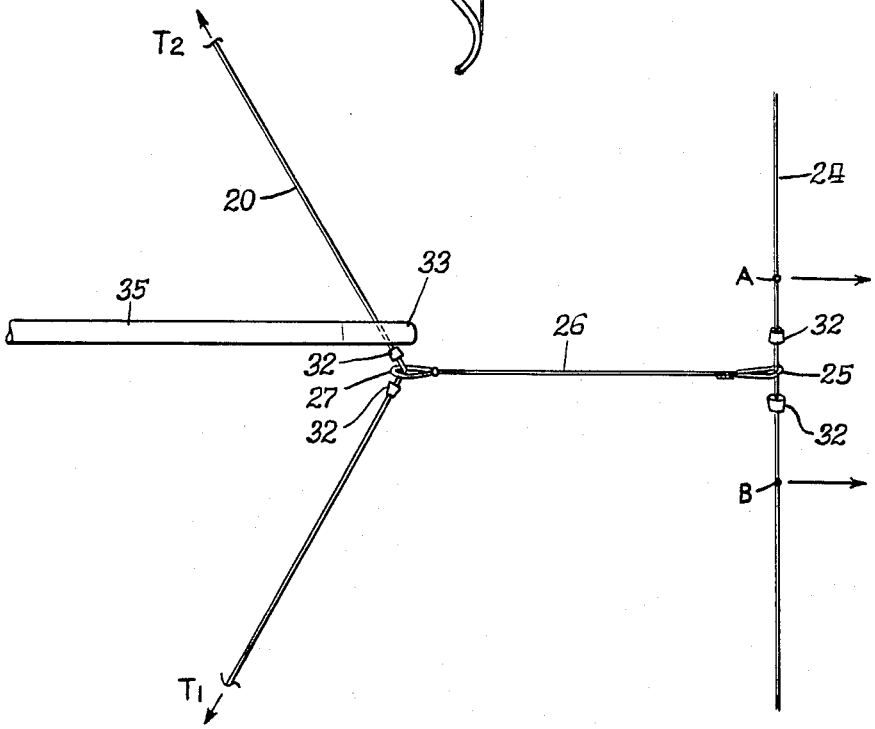
Fig. 2.

ARCHERY BOW

BACKGROUND OF THE INVENTION

1. Field of the Invention

This invention relates to archery bows, and more particularly to archery bows which equalize the tension forces in the arrow propelling bowstring regardless of the manner in which the user applies force to a separate draw bowstring.

2. Description of the Prior Art

A conventional bow has a single bowstring which the user draws and which upon release propels the arrow. When using a conventional archery bow to shoot an arrow, a U-shaped nock on the rear end of the arrow is placed around the bowstring and the string is pulled back by the user. This causes a tension force in each end of the bowstring, between the draw point and the string attachment to the outer end of the limb, and causes energy to be stored in opposite limbs by bending of the limbs. When the string is released, bending forces in the bow limbs and the corresponding tension forces in the string bring the string back to its original position, thrusting the arrow forward. If the forces in each end of the bowstring are equal, and the arrow is properly placed on the string, it will shoot straight, without wobbling. However, if the forces in opposite ends of the bowstring are unequal, such as obtained with uneven finger pressure on the bow string, the arrow will wobble in the vertical plane as it travels through the air, which is known as "porpoising". The arrow may wobble in the horizontal plane due to the bowstring rolling off the fingers unevenly during release of the string. The problems of unbalanced forces in opposite ends of a bowstring are magnified in compound bows which require a synchronization mechanism to overcome such force imbalance. The need for synchronization mechanisms is recognized by the art relating to compound bows as exemplified by U.S. Pat. Nos. 3,981,290 and 4,041,927. Prior synchronization mechanisms to overcome unbalanced forces applied by the bowstring to arrows upon shooting have been very complex.

SUMMARY OF THE INVENTION

In keeping with one aspect of the invention, this archery bow has a riser, primary energy storage means, a propelling bowstring attached to opposite ends of the primary energy storage means, opposing bow limbs in association with opposite ends of the riser with a draw bowstring attached to the outboard ends of the bow limbs, and a bridge means in draw force communication between the central portion of the propelling bowstring and the central position of the draw bowstring. The bow limbs and draw bowstring create a geometrical shape which is larger than and surrounds the geometrical shape created by the primary energy storage means and propelling bowstring. The primary energy storage means may be in the form of the inner portion of the bow limbs or other energy storage means such as a torsion bar or torsion tube or a combination of both. When the primary energy storage is in the inner portion of the bow limbs, the outer portion of the bow limbs to which the draw bowstring is attached is very weak or non-working. Likewise, when the primary energy storage is in an energy storage means other than the inner portion of the bow limbs, the entire bow limb is then very weak or non-working. The bridge means may be in draw force communication between predetermined points on the propelling bowstring and draw bowstring by any suitable means, such as a loop around each bowstring with movement limited by stops. A double bridge string may be connected to two narrowly separated points on the propelling bowstring between which the end of the arrow shaft is attached and a common point on the draw bowstring. Another method of achieving the objects of this invention is to eliminate the bridge string by securing the propelling bowstring directly to the draw bowstring at the desired location.

Accordingly, an object of this invention is to provide a new archery bow which transmits balanced forces to the arrow regardless of the archer's finger pressure variation on the draw string.

Another object is to provide a new compound archery bow which eliminates the need for complicated synchronization mechanisms.

Yet another object is to provide new archery bows which permit shooting shorter arrows to increase speed and reduce tuning difficulties.

Still another object is to provide an archery bow which eliminates finger pinch from holding the end of the arrow while drawing the bow.

BRIEF DESCRIPTION OF THE DRAWINGS

The above mentioned and other features of this invention and the manner of obtaining them will become more apparent, and the invention will be best understood by reference to the following description of preferred embodiments of the invention taken in conjunction with the accompanying drawings in which:

FIG. 1 is a side view of an archery bow of one embodiment of this invention;

FIG. 2 is an enlarged detail view of the bridge string of the bow of FIG. 1;

FIG. 3 is an enlarged detail view of a double bridge string;

FIG. 4 is an enlarged detail view of attachment of the propelling bowstring directly to the draw bowstring;

DESCRIPTION OF THE PREFERRED EMBODIMENTS

Figure 5:
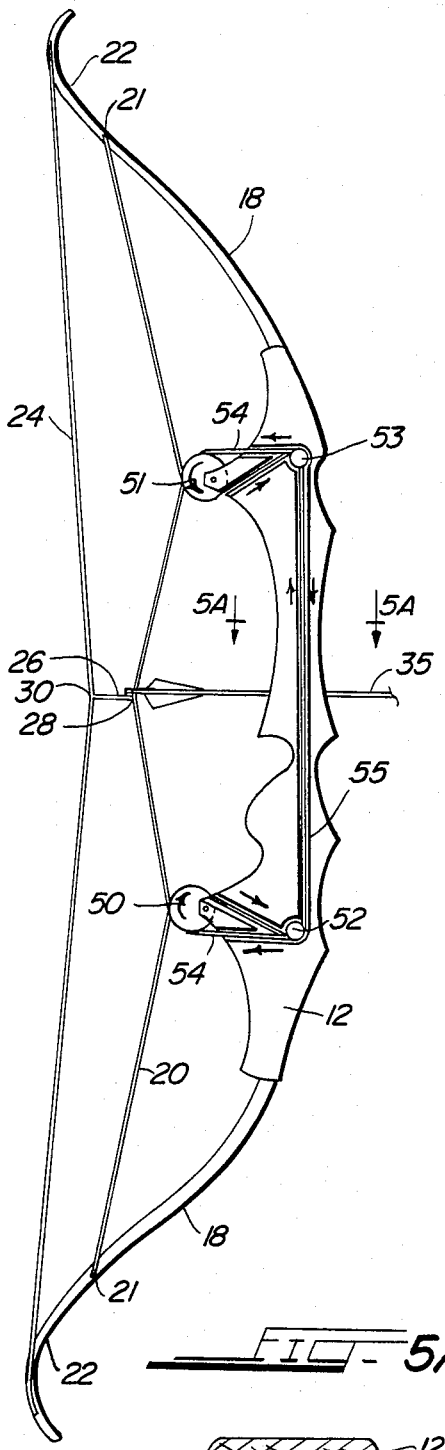
FIG. 5 is a side view of a compound archery bow of another embodiment of this invention providing an additional synchronization means cable.

An archery bow 10 in FIG. 1 has a central riser portion 12 made of rigid material such as wood, plastic, or metal. Riser portion 12 may have an arrow rest 14 for slidably holding an arrow at a predetermined point on riser portion 12 and handle 16 beneath the arrow rest for holding the bow. A pair of bow limbs extend from opposite ends of riser portion 12, and a draw bowstring 24 is attached to the outboard ends of the bow limbs and a propelling bowstring 20 is attached to the bow limbs at intermediate points 21. The inner portion 18 of the bow limbs between propelling bowstring attachments 21 and riser 12 form primary energy storage means. The outer portions 22 of the bow limbs between propelling bowstring attachments 21 and attachment of draw bowstring 24 are weak or non-working as they do not contribute to propulsion of the arrow. The outer bow limb portions 22 and draw bowstring 24 create a geometrical shape which is larger than and surrounds the geometrical shape created by the primary energy storage bow limb portions 18 and propelling bowstring 20.

Bridge string 26, as shown in FIG. 1, extends from draw bowstring 24 to propelling bowstring 20 and is attached to the central portion of draw bowstring 24 by attachment means 30 at one end and to a predetermined point in the central portion of propelling string 20 by attachment means 28 at the opposite end. As shown in more detail in FIG. 2, bridge string 26 extends from draw bowstring 24 to propelling bowstring 20 and is fastened to each by attachment means, loop 27 and loop 25 at opposite ends of bridge string 26. Stops 32 (FIG. 2) placed above and below bridge string 26 on both propelling bowstring 20 and draw bowstring 24 restrain movement of bridge string 26 from a predetermined point on propelling bowstring 20 and draw bowstring 24 while still permitting a flexible attachment to provide application of balanced forces to propelling bowstring 20. As shown in FIGS. 1 and 2, stop 32 which is above bridge string 26 on propelling bowstring 20, provides a predetermined attachment point for nock 33 of arrow 35. Nock 33 may likewise be attached below stop 32 below bridge string 26. Nock 33 includes a generally U-shaped snap-on notch which holds arrow 35 to propelling bowstring 20 when draw bowstring 24 is drawn, but releases upon propelling bowstring 20 reaching its closest position to riser portion 12 after release of drawn draw bowstring 24.

A similar balanced force effect may be obtained using two attachments for a bridge string means as shown in FIG. 3. First bridge string 34 may be secured to upper point 38 on propelling bowstring 20 at a point above the center of propelling bowstring 20. Second bridge string 40 may be secured to propelling bowstring 20 at lower point 42 which is the same distance below the center of propelling bowstring 20 as the distance between the center and upper point 38. Both first bridge string 34 and second bridge string 40 are secured to draw bowstring 24 at common attachment point 36. The nock of the arrow is attached to the central portion pf propelling string 20 between attachment points 38 and 42 which should preferably be spaced just far enough to receive the nock.

Equalized force effects of the bridge means may also be obtained by securing the center of propelling bowstring 20 to draw bowstring 24, as shown in FIG. 4. This can be achieved by fastening the center of the propelling bowstring to the drawstring or by holding them by a small loop. All of these or other methods of application of force from a drawstring to a predetermined location on a propelling string are included in the meaning "bridge means".

In operation, an arrow 35 is placed on rest 14, and nock 33 is snapped onto propelling bowstring 20 just above or below stop 32 as shown in FIGS. 1 and 2. The user holds handle 16 with one hand and draws draw bowstring 24 with the other hand. Generally, one finger is curved around draw bowstring 24 above bridge string 26 (point A in FIG. 2), and two fingers are beneath bridge string 26 (point B in FIG. 2). As the user pulls draw bowstring 24, bridge string 26 pulls propelling bowstring 20 and arrow 35, creating equal tension forces $T_1$ and $T_2$ in propelling bowstring 20. Equal tension forces $T_1$ and $T_2$ cause storage of equal energy in opposite primary energy storage bow limb portions 18. Since the corresponding forces in draw bowstring 24 may not be equal, any energy stored in outer bow limb portions 22 may not be equal. Outer bow limb portions 22 may be much less resistant to force, or more flexible, than primary energy storage bow limb portions 18 to store a relatively much lesser amount of energy or may be entirely non-working. When draw bowstring 24 is released, the equal forces imparted to propelling bowstring 20 by the primary energy storage means of primary energy storage bow limb portions 18 thrust the arrow forward. Due to lesser or no forces in outer bow limb portions 22, draw bowstring 24 prevents bridge string 26 from snapping in front of propelling bowstring 20 and possibly hitting arrow 35 as it leaves the bow. Upon release of draw bowstring 24, the tension in draw bowstring 24 is less than the tension in propelling bowstring 20, to prevent draw bowstring 24 from overriding propelling bowstring 20.

Bridge string 26 is secured to propelling bowstring 20 at a predetermined point which equalizes the forces $T_1$ and $T_2$ in propelling bowstring 20. If the user exerts unequal pressure on points A and B, or pulls up or down slightly on draw bowstring 24, the unequal or disoriented forces will not be transmitted by bridge string 26 to propelling bowstring 20 so that the forces exerted on propelling bowstring 20 always result in equal forces $T_1$ and $T_2$. Also, string torque which may be applied to draw bowstring 24 will not be transmitted to bridge string 26 or propelling bowstring 20.

The principle of this invention involving a separate draw bowstring and propelling bowstring has been described as it applies to a simple bow. The invention is equally applicable to all types of compound bows. In the past all compound bows have required synchronization between opposing limbs. A wide variety of attempts to obtain effective and simple synchronization have been recognized, as exemplified by U.S. Pat. No. 3,981,290. Application of this invention to a compound bow reduces and usually completely eliminates the need for additional synchronization. Any compound bow may be used for applying desired force to the arrow propelling bowstring and with utilization of the double bowstring of this invention no additional synchronization for the opposing limbs is usually necessary.

The principle of this invention involving a separate draw bowstring and propelling bowstring has particularly advantageous application to bows having a compound bow effect as a result of eccentric means, such as eccentric pulleys or programmed cams. One embodiment of such a compound bow effect according to this invention is shown in FIG. 5. As shown in FIG. 5, draw bowstring 24 and propelling bowstring 20 are attached at their ends to opposing bow limbs in the same manner as described with respect to FIG. 1. Likewise, bridge string 26 extends from draw bowstring 24 to propelling bowstring 20 in their central portions. Any of bridge means previously described is suitable. As shown in FIG. 5, bow riser portion 12 is adapted for mounting of eccentric means 50 in its lower portion and eccentric means 51 in its upper portion. By the terminology "eccentric means", I intend to include any mechanism imparting eccentric action, such as eccentrically mounted round or non-round pulleys or programmed cams around which the bowstring extends or to which the ends of the bowstring may be attached. Having propelling bowstring 20 attached to eccentric means 50 and 51 rotating in the direction of the arrows when draw bowstring 24 is pulled imparts a compound effect to the bow which operates, otherwise, in the same fashion as described with respect to the bow shown in FIG. 1. A further advantage of the compound bow of this invention, such as shown in FIG. 5, is that it may be completely unstrung by detachment of drawstring 24 and propelling string 20 from the bow limbs.

Figure 5A:
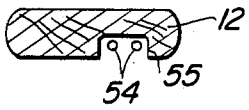
FIG. 5A is a sectional view through 5A—5A shown in FIG. 5.
Figure 8:
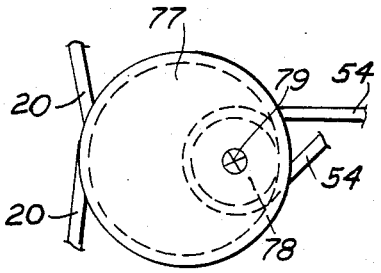
FIG. 8 is an enlarged detail view of a double pulley used in this invention.

While the compound bow as described above does not usually require synchronization between the upper and lower eccentric means, due to equal forces being applied by propelling bowstring 20 to each of the eccentric means 50 and 51, FIG. 5 illustrates one embodiment of incorporation of a synchronization cable, in cases in which it may be desirable. FIG. 8 shows a suitable eccentric means 77 pivoting about pivot point 79 for eccentric operation of propelling bowstring 20 with mounting on the same axis 79 of concentric means 78 which may be utilized for synchronization cable 54. In the embodiment of FIG. 5 utilizing synchronization cable 54 eccentric means 50 and 51 may be replaced by the combination of eccentric means 77 and concentric means 78. As shown in FIG. 5, synchronization cable 54 is an endless cable passing around upper concentric rotation means which is operated in rotational phase with eccentric means 51 and lower concentric rotational means operated in rotational phase with lower eccentric means 50. As shown, the synchronization cable may be conveniently led through groove 55 in bow riser portion 12 and over lower double idler pulley 52 and upper double idler pulley 53. FIG. 5A shows a sectional view of passage of the two portions of synchronization cable 54 through synchronization cable groove 55 in riser portion 12. The arrows indicate movement of synchronization cable 54 as the concentric pulleys operate in the direction indicated by the arrows of the eccentric means 50 and 51.

Figure 6:
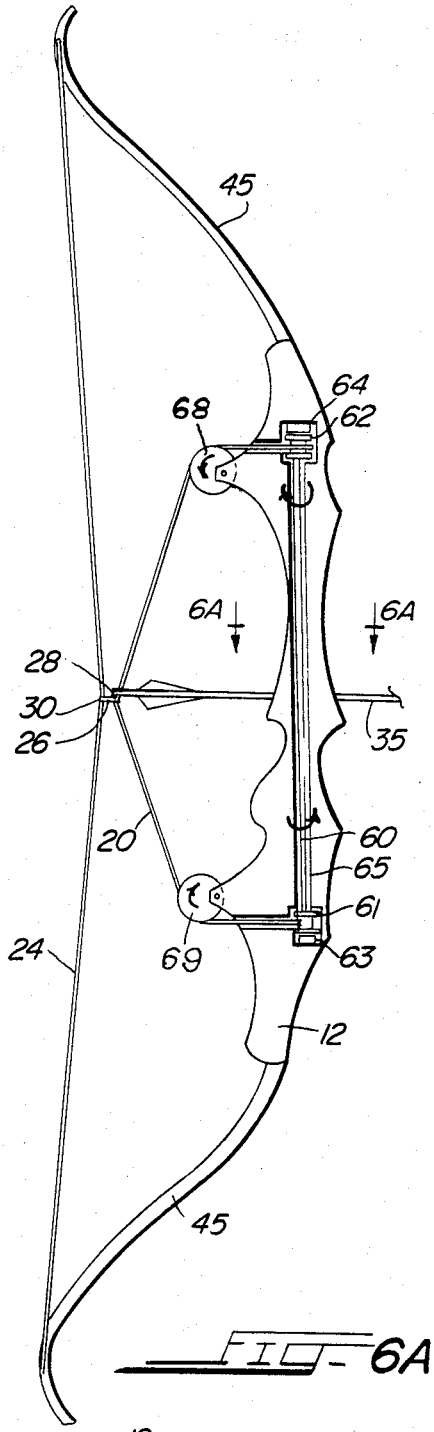
FIG. 6 is a side view of an archery bow of another embodiment of this invention providing primary energy storage in a torsion means.
Figure 6A:
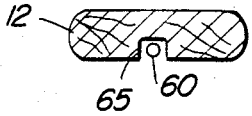
FIG. 6A is a sectional view through 6A—6A shown in FIG. 6.

The principle of this invention involving a separate draw bowstring and propelling bowstring has particularly advantageous application to bows with torsion element primary energy storage means, such as taught by U.S. Pat. No. 4,244,345. FIG. 6 is a side view of a typical archery bow having a torsion element primary energy storage means in the undrawn position and embodying features of this invention. The torsion bow has central riser portion 12 with bow limbs 45 extending outwardly from opposite ends of the riser portion and draw bowstring 24 extends between the outer ends of the opposing bow limbs. FIG. 6 shows torsion rod or torsion tube primary energy storage means 60 rotatably attached to opposite ends of riser 12 by bearing mountings 63 and 64. Fixed attachments means 61 and 62 are attached in non-rotatable relation to opposite ends of torsion energy storage means 60. Opposite ends of propelling bowstring 20 are attached to attachment means 61 and 62 in force transmitting relation to impart forces in the direction indicated by the arrows upon drawing draw bowstring 24. The configuration of the torsion element primary energy storage means may be a torsion rod or torsion tube or combination of a torsion rod and torsion tube mounted so as to store energy applied by opposite rotation forces to opposite ends of the torsion rod or tube or combination by drawing of draw bowstring 24 and thus upon release of draw bowstring 24 imparting equal and opposite forces to opposite ends of propelling bowstring 20. As shown in FIG. 6, bridge string 26 is attached to the central portion of draw bowstring 24 by attachment means 30 at one end and is attached to a predetermined pointed in the central portion of propelling bowstring 20 by attachment means 28 at the opposite end in the same fashion as described with respect to FIGS. 1–4. Propelling bowstring 20 is shown passing over eccentric means 68 and 69 with its opposite ends attached in opposite rotary force transmitting relation with force transmitting attachment means 61 and 62 fixed to opposite ends of the torsion element primary force storage means. The torsion primary force storage means functions in the manner described in U.S. Pat. No. 4,244,345 with rotational forces in the direction of the arrows shown in FIG. 6. While a compound effect is obtained by use of eccentric means 61 and 62 as shown, the torsion primary force storage means may be used with the double bowstring of this invention in the same manner when concentric means are directly substituted for eccentric means 68 and 69.

Figure 7:
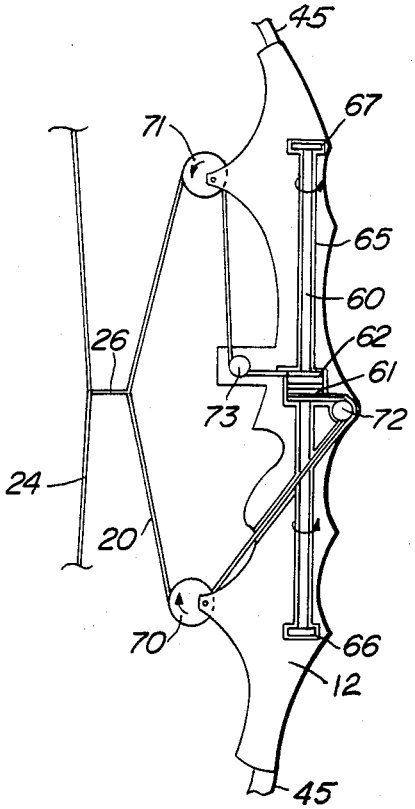
FIG. 7 is a partial side view of a bow of another embodiment of this invention providing primary energy storage in a torsion means.

FIG. 7 shows another embodiment of this invention utilizing a torsion primary force storage means. In the embodiment shown in FIG. 7, primary force storage means 60 is fixedly mounted at both ends, with respect to riser portion 12 by fixed end mounting means 66 and 67. Draw bowstring 24 and propelling bowstring 20 are connected by bridge means 26 in the same fashion as described above. The upper portion of propelling bowstring 20 passes over eccentric or concentric means 71, pulley means 73 and is attached to attachment means 62 in non-rotatable relation to torsion energy storage means 60. In similar manner, the lower portion of propelling bowstring 20 extends around eccentric or concentric means 70, pulley 72 and is attached to attachment means 61 which is non-rotatably mounted on torsion energy storage means 60. Attachment of propelling bowstring 20 to attachment means 61 and 62 is in a fashion such that upon drawing of draw bowstring 24, and rotation of eccentric means 70 and 71 in the direction indicated by the arrows, rotational force. will be applied by the opposite ends of propelling bowstring 20 to torsion energy storage means in the same direction, as indicated by the arrows in FIG. 7. In this embodiment, torsion energy storage means 60 may be conveniently recessed within the handle in groove 65.

Figure 9:
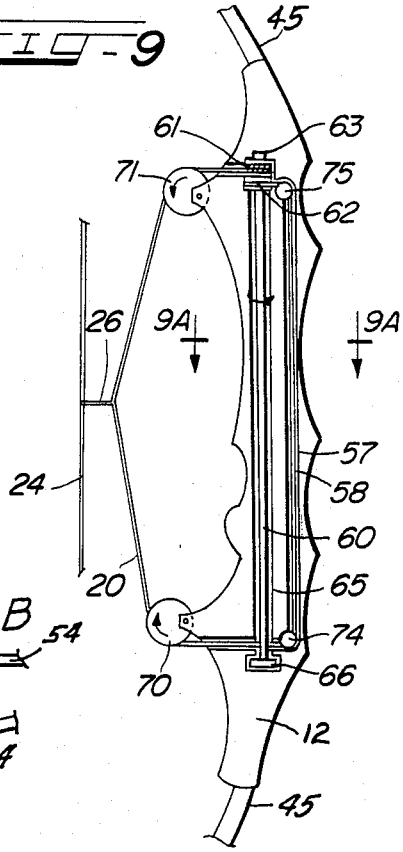
FIG. 9 is a partial side view of a bow of another embodiment of this invention providing primary energy storage in a torsion means.
Figure 9A:
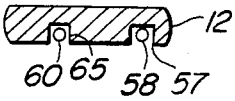
FIG. 9A is a sectional view through 9A—9A shown in FIG. 9.
Figure 8A:
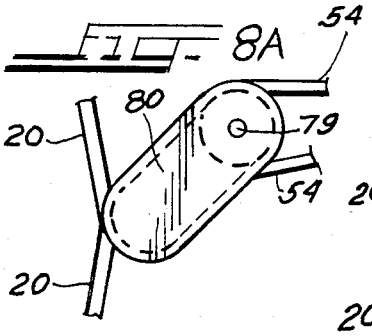
FIG. 8A is another embodiment of a double pulley using a symmetrical oblong eccentric.
Figure 8B:
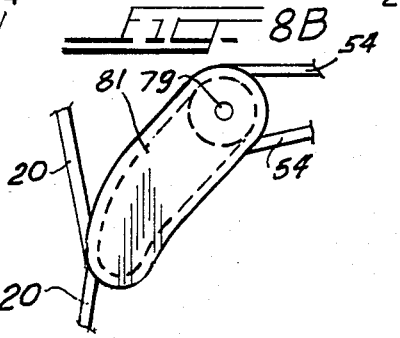
FIG. 8B is another embodiment of a double pulley using an unsymmetrical or programmed cam.

FIG. 9 shows another embodiment of this invention wherein the primary energy storage means is a torsion element. As shown in FIG. 9, torsion element 60 has fixed end mounting means 66 at one end holding that end of torsion means non-rotatable with respect to riser portion 12 and bearing mounting means 63 at the other end allowing rotation of that end of torsion energy storage means 60. The upper end of propelling bowstring 20 passes over eccentric means 71 and is attached in force transmitting relationship to attachment means 61 which is non-rotatably mounted on torsion energy storage means 60. Likewise, the lower portion of propelling bowstring 20 passes over eccentric 70, idler pulley 74, idler pulley 75, and is attached to attachment means 62, both ends of propelling bowstring 20 being attached to their respective attachment means in a fashion to cause the same direction rotational forces upon torsion energy storage means 60 by a draw force being applied to draw bowstring 24. The configuration shown in FIG. 9 may be conveniently recessed into the bow handle as shown in FIG. 9A by placing torsion energy storage means 60 in recess 65 and cable or propelling bowstring 58 in recess 57.

The torsion energy storage means eliminates any requirement for synchronization and a single point adjustment means may be used to adjust the force required to be applied to draw bowstring 24. While the invention has been described with respect to eccentrics mounted on riser portion 12, such as 70 and 71 in FIGS. 7 and 9, it should be readily apparent that the attachment means to the primary force energy storage means, such as 61 and 62, may be eccentric to either provide all of the desired eccentricity, or additional eccentricity.

The propelling bowstring and the draw bowstring of this invention may be made of materials as presently used for single bowstrings. The bridge string may be of the same material as the bowstrings or may be made of non-elongating material such as wire, or cable.

It is an important feature of this invention, whether it is applied to a simple or a compound bow, that an arrow propelling bowstring is attached at its opposite ends in force communication to a primary energy storage means and a draw bowstring is attached at its opposite ends in force communication to a secondary energy storage means, the draw bowstring also being attached in its central portion by a bridge means in draw force communication to a predetermined central position on the propelling bowsting. Thus the tension in the propelling bowstring and the force in opposite ends of the primary force storage means is equal and when released propels the arrow in a reproducible fashion without wobble or porpoising. Several different ways of providing suitable primary energy storage means have been taught. The two-string bows of this invention eliminate transference to the arrow of finger torque or uneven force application and string roll caused by the fingers. The present invention reduces conventional bowstring oscillation. The present invention eliminates finger pinch from holding the arrow. The bows of this invention provide the advantages of shooting shorter arrows, furnishing more arrow speed and easier tuning, without the disadvantages of overdraw bow's accentuation of torque effects, plus the inherent danger of drawing the point of an arrow behind the wrist.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In an archery bow of the type having an elongated rigid central riser portion with energy storage means attached to opposite end portions and an arrow engaging and propelling bowstring attached to said energy storage means, the improvement comprising; a primary energy storage means having said propelling bowstring attached thereto at opposite ends; bow limbs extending outwardly from each opposite end of said riser having a draw bowstring attached thereto at opposite ends, said draw bowstring and said bow limbs defining a shape larger than the shape defined by said propelling bowstring and said primary energy storage means; and a force transmitting bridge means in draw force communication between a predetermined attached position on said propelling bowstring and a predetermined attached position said draw bowstring whereby when a draw force is applied by a user to said draw bowstring said draw force is transmitted to said propelling bowstring only at said predetermined attached position on said propelling bowstring, so as to provide a force for launching an arrow engaging said propelling bowstring.

2. The bow of claim 1 wherein said bow comprises a compound bow.

3. The bow of claim 1 wherein said primary energy storage means comprises the inboard portion of said bow limbs whose outer portion comprises a non-working portion.

4. The bow of claim 1 wherein compound effect is imparted by said propelling bowstring passing over an eccentric means mounted at each end of said riser portion.

5. The bow of claim 1 wherein said primary energy storage means comprises at least one torsion energy storage element.

6. The bow of claim 1 wherein said bridge means comprises securement of said propelling bowstring at said predetermined position directly to said draw bowstring.

7. The bow of claim 1 wherein said bridge means comprises a bridge string attached to said draw bowstring by attachment means at one end and to said propelling bowstring at said predetermined position by attachment means at the other end of said bridge string.

8. The bow of claim 7 wherein each of said attachment means comprises a loop, one of said loops around said propelling bowstring and the other of said loops around said draw bowstring.

9. The bow of claim 8 wherein said loops are restrained in movement along said propelling bowstring and said draw bowstring by upper and lower stops on each said bowstring.

10. The bow of claim 1 wherein said bridge means comprises a first bridge string and a second bridge string, said bridge strings attached at one end to said draw bowstring and at their other end to said propelling bowstring predetermined position in spaced relation with separate attachment means, one of said separate attachment means in close proximity to one side of the arrow nock location and the other of said separate attachment means in close proximity to the other side of the arrow nock location.

11. The bow of claim 1 wherein said primary energy storage means comprises torsion energy storage means and said bridge means comprises a bridge string attached to said draw bowstring by attachment means at one end and to said propelling bowstring at said predetermined position by attachment means at the other end of said bridge string.

12. An archery bow comprising: an elongated rigid central riser; an elongated primary energy storage means having an arrow engaging and propelling bowstring attached thereto; bow limbs extending outwardly from each opposite end of said riser and having a draw bowstring attached thereto at opposite ends; said draw bowstring and said bow limbs defining a shape larger than the shape defined by said propelling bowstring and said primary energy storage means in both the drawn and undrawn conditions; and a force transitting bridge means in draw force communication between a predetermined attached position on said propelling bowstring and a predetermined attached position on said draw bowstring whereby when a draw force is applied to said draws bowstring said draw force is transmitted to said propelling bowstring only at said predetermined attached position on said propelling bowstring, so as to provide a force for launching an arrow engaging said propelling bowstring.

13. The bow of claim 12 wherein said bow comprises a compound bow.

14. The bow of claim 12 wherein said primary energy storage means comprises the inboard comprises a non-working portion.

15. The bow of claim 12 wherein compound effect is imparted by said propelling bowstring passing over an eccentric means mounted at each end of said riser portion.

16. The bow of claim 12 wherein said primary energy storage means comprises at least one torsion energy storage element.

17. The bow of claim 12 wherein said bridge means comprises securement of said propelling bowstring at said predetermined position directly to said draw bowstring.

18. The bow of claim 12 wherein said bridge means comprises a bridge string attached to said draw bowstring by attachment means at one end and to said propelling bowstring at said predetermined position by attachment means at the other end of said bridge string.

19. The bow of claim 18 wherein each of said attachment means comprises a loop, one of said loops around said propelling bowstring and the other of said loops around said draw bowstring.

20. The bow of claim 19 wherein said loops are restrained in movement along said propelling bowstring and said draw bowstring by upper and lower stops on each said bowstring.

21. The bow of claim 12 wherein said bridge means comprises a first bridge string and a second bridge string, said bridge strings attached at one end to said draw bowstring and at their other end to said propelling bowstring predetermined position in spaced relation with separate attachment means, one of said separate attachment means in close proximity to one side of the arrow nock location and the other of said separate attachment means in close proximity to the other side of the arrow nock location.

22. The bow of claim 12 wherein said primary energy storage means comprises torsion energy storage means and said bridge means comprises a bridge string attached to said draw bowstring by attachment means at one end and to said propelling bowstring at said predetermined position by attachment means at the other end of said bridge string.

* * * * *